US006919849B2

(12) United States Patent
Yang

(10) Patent No.: US 6,919,849 B2
(45) Date of Patent: Jul. 19, 2005

(54) INTEGRATED GLASS ANTENNA FOR AUTOMOBILE

(75) Inventor: Sung Wan Yang, Gunpo-si (KR)

(73) Assignee: Kia Motors Corporation, Seoul (KR)

( * ) Notice: Subject to any disclaimer, the term of this patent is extended or adjusted under 35 U.S.C. 154(b) by 90 days.

(21) Appl. No.: 10/677,974

(22) Filed: Oct. 1, 2003

(65) Prior Publication Data

US 2004/0113855 A1 Jun. 17, 2004

(30) Foreign Application Priority Data

Oct. 31, 2002 (KR) ..... 2002-0066862

(51) Int. Cl.[7] ..... H01Q 1/32
(52) U.S. Cl. ..... 343/713; 343/828
(58) Field of Search ..... 343/713, 704, 343/711, 828, 909, 972

(56) References Cited

U.S. PATENT DOCUMENTS 5,364,685 A * 11/1994 Nakashima et al. ..... 428/155
5,499,034 A * 3/1996 Fujii et al. ..... 343/713
6,433,749 B1 * 8/2002 Thompson ..... 343/713

* cited by examiner

*Primary Examiner*—Don Wong
*Assistant Examiner*—Jimmy Vu
(74) *Attorney, Agent, or Firm*—Morgan Lewis & Bockius LLP

(57) ABSTRACT

The present invention relates to an integrated glass antenna for an automobile, and more particularly, to an integrated glass antenna for an automobile in which an antenna constructed by incorporating a mobile telematics system (MTS) antenna into a radio and television antenna is integrated into a window glass of the automobile. The integrated glass antenna for the automobile with predetermined pattern conductors spaced apart by a predetermined interval from heating wires on a rear window glass of the automobile comprises a radio antenna connected to a radio circuit of the automobile; a television antenna formed to be spaced apart by a predetermined interval from the radio antenna and connected to a television circuit of the automobile; and an MTS antenna formed to be spaced apart by predetermined intervals from the radio antenna and the television antenna, respectively, and connected to an MTS circuit of the automobile. Thus, a space and working man-hour needed for installing the MTS antenna can be reduced, the beauty of an external appearance thereof can be improved, and the receive sensitivity of the MTS antenna can be enhanced.

4 Claims, 1 Drawing Sheet

INTEGRATED GLASS ANTENNA FOR AUTOMOBILE

CROSS-REFERENCE TO RELATED APPLICATIONS

This application claims priority of Korean Application No. 2002-66862, filed on Oct. 31, 2002, the disclosure of which is incorporated fully herein by reference.

FIELD OF INVENTION

The present invention relates to an integrated glass antenna for an automobile, and more particularly, to an integrated glass antenna for an automobile in which an antenna constructed by incorporating a mobile telematics system (MTS) antenna into a radio and television antenna is integrated into a window glass of an automobile, whereby the space and time needed for installing the MTS antenna can be reduced, the external appearance thereof can be improved, and the sensitivity of the MTS antenna can be enhanced.

BACKGROUND OF THE INVENTION

MTS is a wireless data service for providing information during traveling of vehicles, i.e. a wireless data service for transmitting and receiving information to and from computers installed in the vehicles such as automobiles, aircrafts and ships by using wireless communication technology, satellite navigation equipment, text-to-speech signal conversion technology through the Internet, and the like.

Particularly, an automobile telematics service provides, in real time, information regarding automobile accidents or theft detection of automobiles, driving path guidance, traffic and living information, games, and the like by applying mobile communication technology and global positioning technology to automobiles.

In the automobile telematics service, if an automobile is out of order during traveling thereof, a computer in the automobile is connected to a service center through wireless communications and the driver can receive and see an electronic mail and a road map through a computer monitor in front of a driver's seat. Further, a passenger can enjoy a computer game through a monitor installed at a rear seat, and a microcomputer installed in an engine room of the automobile can record the status of major components of the automobile so as to correctly inform a car mechanic of a correct failure position and cause at any time.

Typically, an MTS antenna for automobiles is an external rod antenna. However, since such a telematics rod antenna is additionally installed on a roof or the like of the automobile to protrude therefrom, there is a disadvantage in that an external appearance of the automobile is deteriorated. Further, there are problems in that the road antenna is likely to interfere with surrounding natural features or installations, and costs are increased.

Another type of antenna used in automobiles is the glass antenna. A glass antenna is mounted on or in a window glass of an automobile and has been widely used to receive radio and television signals. Since such a glass antenna does not require an additional antenna telescopic device and an additional installation space contrary to a conventional telescopic antenna, the use of the glass antenna has been recently increased. Such glass antennas have not, however, been suitable for functions of telematics, GPS and the like.

SUMMARY OF THE INVENTION

According to an embodiment of the present invention, there is provided an integrated glass antenna for an automobile with predetermined pattern conductors spaced apart by a predetermined interval from heating wires on a rear window glass of the automobile, comprising a radio antenna connected to a radio circuit of the automobile; a television antenna formed to be spaced apart by a predetermined interval from the radio antenna and connected to a television circuit of the automobile; and an MTS antenna formed to be spaced apart by predetermined intervals from the radio antenna and the television antenna, respectively, and connected to an MTS circuit of the automobile.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
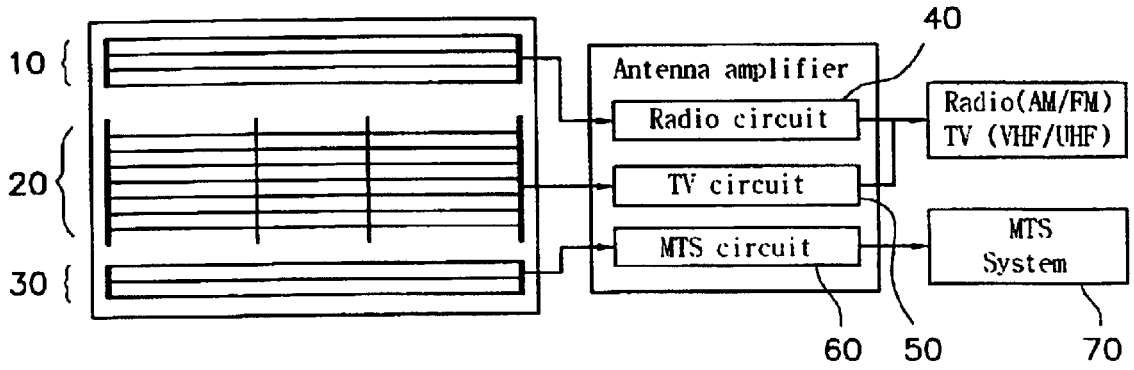
FIG. 1 is a schematic view showing an embodiment of an integrated glass antenna for an automobile according to the present invention.

As shown in FIG. 1, glass antenna with predetermined patterned conductors spaced apart by a predetermined interval from heating wires on a rear window glass of an automobile according to the present invention comprises a radio antenna 10 connected to a radio circuit 40 of the automobile; a television antenna 20 formed to be spaced apart by a predetermined interval from the radio antenna 10 and connected to a television circuit 50 of the automobile; and an MTS antenna 30 formed to be spaced apart by predetermined intervals from the radio antenna 10 and the television antenna 20, respectively, and connected to an MTS circuit 60 of the automobile.

Thus, an MTS system 70 can be used by forming patterns integrated into the glass antenna of the automobile instead of attaching an additional antenna.

Figure 2:
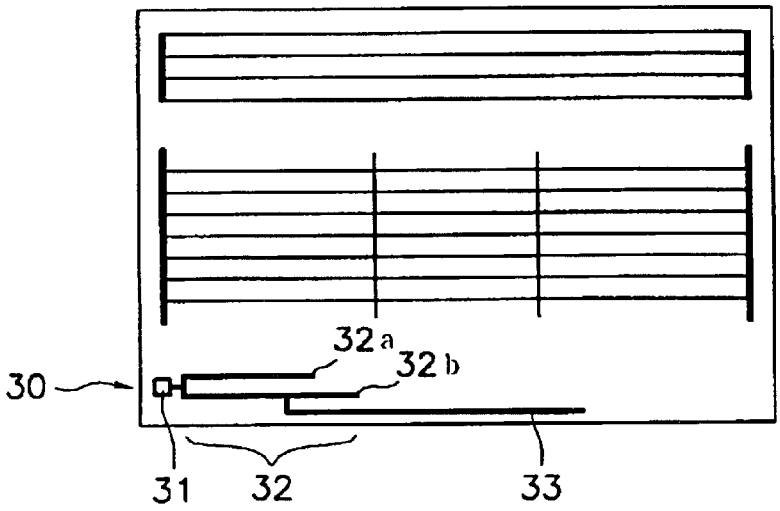
FIG. 2 is a schematic view showing an example in which the integrated glass antenna for an automobile according to the present invention is practically applied to a specific automobile.

FIG. 2 is a schematic view showing an example in which the integrated glass antenna for the automobile according to the present invention is practically applied to a specific automobile. The MTS antenna 30 comprises a feed point 31 connected to the MTS circuit 60 at a side of the rear window glass of the automobile, and an antenna unit 32 branching out from the feed point 31 and both branch portion 32*a*, 32*b* angled to one direction.

Branch portions 32*a*, 32*b* of the antenna unit 32 have different predetermined lengths, respectively. Since the pattern of the antenna unit 32 is influenced directly by a shape of a body of the automobile, the entire pattern including lengths and widths is determined differently depending on the kinds of automobiles.

Further, an impedance matching bar 33 is used at an end of the antenna unit 32, if necessary. Then, the length of the impedance matching bar 33 can be adjusted by using a network analyzer (not shown) for causing an impedance at a transmitting/receiving center frequency to be around 50 Ohms.

Hereinafter, the operation and effects of the present invention will be described with reference to FIGS. 1 and 2.

For a transmitting/receiving frequency band of the MTS system 70 applied to the present invention, high frequencies of 90 to 850 MHz and 1.2 to 2.5 GHz are used.

An impedance of the antenna is 50 Ohms, and a wavelength is calculated based on an equation of $\lambda=c/f$, where c=the velocity of an electromagnetic wave and f is a frequency. Therefore, in a case where a frequency of 850 MHz is applied, the wavelength becomes $3\times10^8$ (m/s)÷($850\times10^6$) ≈35 (cm). The optimal receiving performance (resonance) of an antenna is obtained when the length of the antenna is ½ or ¼ times as large as a wavelength. Accordingly, the length of the pattern of the antenna is tuned based on 35 (cm)×¼= 8.8 (cm).

When the length of the antenna unit 32 is tuned, in case of using the optional impedance matching bar 33 as such, the length of the impedance matching bar 33 is adjusted by using the network analyzer so that the impedance at the transmitting/receiving center frequency can be around 50 Ohms.

An L/R time constant of impedance matching of an amplifier module of the MTS circuit 60 is set so that its value becomes a value where input signals can be maximally received.

The tuning of the length and width of the pattern of the antenna unit 32 is determined based on a transmitting/receiving frequency band of radio equipment to be used, input/output impedances of the radio equipment, a tuning method of the amplifier module, an available area of a window surface of an automobile, and a tilt angle of the window surface of the automobile with respect to the ground, and the like. Thus, the length and width vary according to the kinds of automobiles.

Since the MTS antenna 30 of the present invention constructed as such is manufactured by adding an antenna pattern to a conventional glass antenna upon manufacture thereof, the same production process can also be applied thereto. The addition of the MTS circuit 60 or an additional amplifier for the MTS circuit 60 to a conventional antenna amplifier with the radio circuit 40 and the television circuit 50 enables use of one integrated glass antenna.

According to the present invention, the MTS antenna incorporated into the radio and television antenna is integrated into the window glass of the automobile, so that a space and working man-hour needed for installing the MTS antenna can be reduced, the beauty of an external appearance thereof can be improved, and the receive sensitivity of the MTS antenna can be enhanced.

The embodiment has been described by way of example for specifically explaining the technical spirit of the invention. The scope of the invention is not limited to the embodiment and the details shown in the drawings.

What is claimed is:

1. An integrated glass antenna for an automobile with predetermined pattern conductors spaced apart by a predetermined interval from heating wires on a rear window glass of the automobile, comprising:

a radio antenna connected to a radio circuit of the automobile;

a television antenna formed to be spaced apart by a predetermined interval from the radio antenna and connected to a television circuit of the automobile; and an MTS antenna formed to be spaced apart by predetermined intervals from the radio antenna and the television antenna, respectively, and connected to an MTS circuit of the automobile.

2. The integrated glass antenna as claimed in claim 1, wherein the MTS antenna comprises a feed point connected to the MTS circuit at a side of the rear window glass of the automobile, and an antenna branching out from the feed point and both branch portion angled to one direction.

3. The integrated glass antenna as claimed in claim 2, wherein branch portions of the antenna unit have different predetermined lengths, and the lengths and widths of the branch portions are determined differently depending on the kinds of automobiles.

4. The integrated glass antenna as claimed in claim 2, wherein the MTS antenna further includes an impedance matching bar.

* * * * *